United States Patent [19]

Uchino et al.

[11] 4,267,586

[45] May 12, 1981

[54] ELECTROPHONIC MUSICAL INSTRUMENT

[75] Inventors: Misao Uchino; Minoru Watanabe, both of Tokorozawa, Japan

[73] Assignee: Citizen Watch Co., Ltd., Tokyo, Japan

[21] Appl. No.: 13,119

[22] Filed: Feb. 21, 1979

[30] Foreign Application Priority Data

Feb. 22, 1978 [JP] Japan ..... 53-19392

[51] Int. Cl.[3] ..... G04C 21/28; G10H 1/26

[52] U.S. Cl. ..... 368/73; 368/107; 368/109; 368/155; 368/272; 84/1.01; 84/1.03

[58] Field of Search ..... 58/12, 23 R, 23 D, 38 R, 58/50 R, 57.5; 84/1.01, 1.03, 115, 462, DIG. 2, DIG. 8, DIG. 10, DIG. 20, DIG. 24; 368/73, 107, 109, 155, 272

[56] References Cited

U.S. PATENT DOCUMENTS

| | | | |
|---|---|---|---|
| 3,626,350 | 12/1971 | Suzuki et al. | 84/DIG. 8 |
| 3,821,712 | 6/1974 | Wetzel | 84/1.01 |
| 3,878,750 | 4/1975 | Kapps | 84/1.01 |
| 3,890,871 | 6/1975 | Oberheim | 84/1.01 |
| 3,955,459 | 5/1976 | Mochida et al. | 84/1.01 |
| 4,046,047 | 9/1977 | Roberts | 84/1.01 |
| 4,090,349 | 5/1978 | Takase | 58/12 |

*Primary Examiner*—Stanley J. Witkowski

*Attorney, Agent, or Firm*—Jordan and Hamburg

[57] ABSTRACT

An electrophonic musical instrument which can be of sufficiently small size to be incorporated in a portable electronic timepiece, having operating members which serve to input data corresponding to pitch and timing information for a sequence of musical notes to be stored in an internal memory, and having means whereby said sequence of musical notes can be subsequently automatically reproduced audibly by actuating another operating member.

4 Claims, 9 Drawing Figures

| Fig. 1(A) | Fig. 1(B) |
|---|---|

| ADDRESS | DATA | | | | | | | | ADDRESS | DATA | | | | | | | |
|---|---|---|---|---|---|---|---|---|---|---|---|---|---|---|---|---|---|
| | $b_0$ | $b_1$ | $b_2$ | $b_3$ | $b_4$ | $b_5$ | $b_6$ | $b_7$ | $b_8$ | | $b_0$ | $b_1$ | $b_2$ | $b_3$ | $b_4$ | $b_5$ | $b_6$ | $b_7$ | $b_8$ |
| 0 | 0 | 1 | 0 | 1 | 1 | 0 | 0 | 0 | 0 | 7 | 1 | 0 | 1 | 1 | 1 | 0 | 0 | 0 | 0 |
| 1 | 0 | 0 | 1 | 0 | 1 | 0 | 0 | 0 | 0 | 8 | 1 | 0 | 1 | 1 | 0 | 0 | 0 | 0 | 0 |
| 2 | 0 | 0 | 0 | 0 | 1 | 0 | 0 | 0 | 0 | 9 | 1 | 1 | 1 | 0 | 1 | 1 | 0 | 0 | 0 |
| 3 | 1 | 0 | 0 | 1 | 0 | 0 | 0 | 0 | 0 | 10 | 1 | 0 | 1 | 1 | 1 | 0 | 0 | 0 | 0 |
| 4 | 1 | 0 | 0 | 1 | 0 | 0 | 0 | 0 | 0 | 11 | 0 | 0 | 1 | 1 | 1 | 0 | 0 | 0 | 0 |
| 5 | 0 | 0 | 0 | 1 | 0 | 0 | 0 | 0 | 0 | 12 | 0 | 0 | 1 | 1 | 0 | 0 | 0 | 0 | 0 |
| 6 | 0 | 0 | 1 | 1 | 0 | 0 | 0 | 0 | 0 | 13 | 0 | 1 | 0 | 0 | 0 | 0 | 0 | 0 | 1 |

ELECTROPHONIC MUSICAL INSTRUMENT

This invention relates to an electrophonic musical instrument which can be of extremely small size and can be used to record and reproduce a desired sequence of musical notes, utilizing digital data processing techniques.

There are certain applications of electronic musical recording devices for which an extremely small size is desirable. Such applications include, for example, a device which can be accommodated in an electronic timepiece such as an electronic wristwatch and which will automatically play a predetermined tune or sequence of musical notes at some desired time, for such purposes as to provide an alarm signal. Various types of device can be used to record a sequence of musical notes, such as a tape recorder or phonograph. However these are of too large size to be suitable for the type of application mentioned above, due to the various mechanical components which they incorporate.

With an electronic musical recording device in accordance with the present invention, the overall size can be extremely compact, since all components other than external operating members and the audio signal transducer can be formed on an electronic integrated circuit. Data concerning the pitch and the timing of a sequence of musical notes can be input, in the order in which the notes would appear on a musical score, and the data are stored in a memory circuit. Subsequently, the data can be read out of the memory at any desired time and used to reproduce the sequence of musical notes audibly, for entertainment or to provide an alarm signal, etc.

It is therefore an object of the present invention to provide an electronic musical recording device which can be made of extremely small size.

Further objects, features and advantages of the present invention will be made more apparent from the following description, when taken in conjunction with the attached drawings, whose scope is given by the appended claims.

In the drawings:

FIGS. 1, (A) and 1(B) are a general circuit diagram of an embodiment of an electrophonic musical instrument in accordance with the present invention;

Figures 1, 1A:
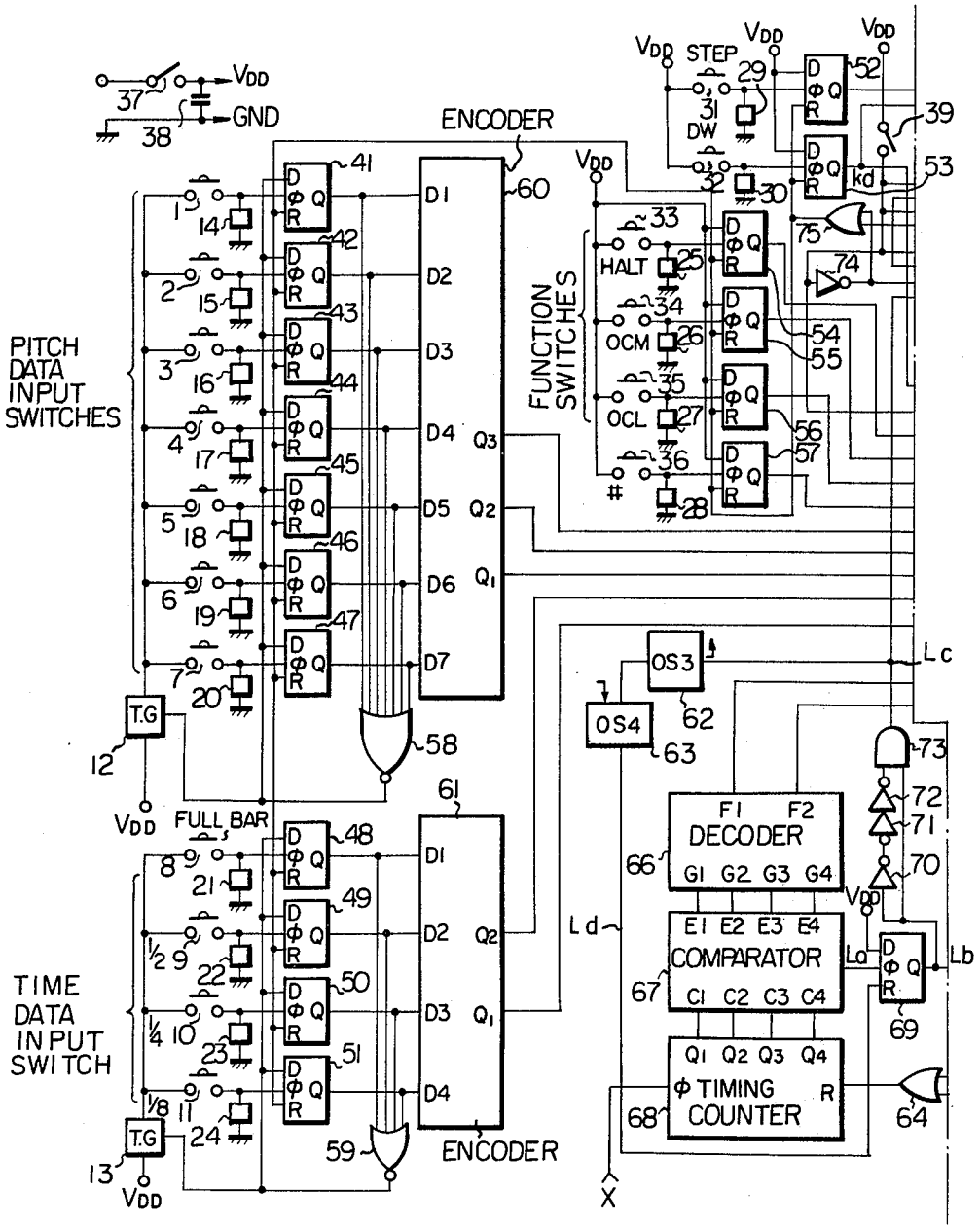
Figure 1B:
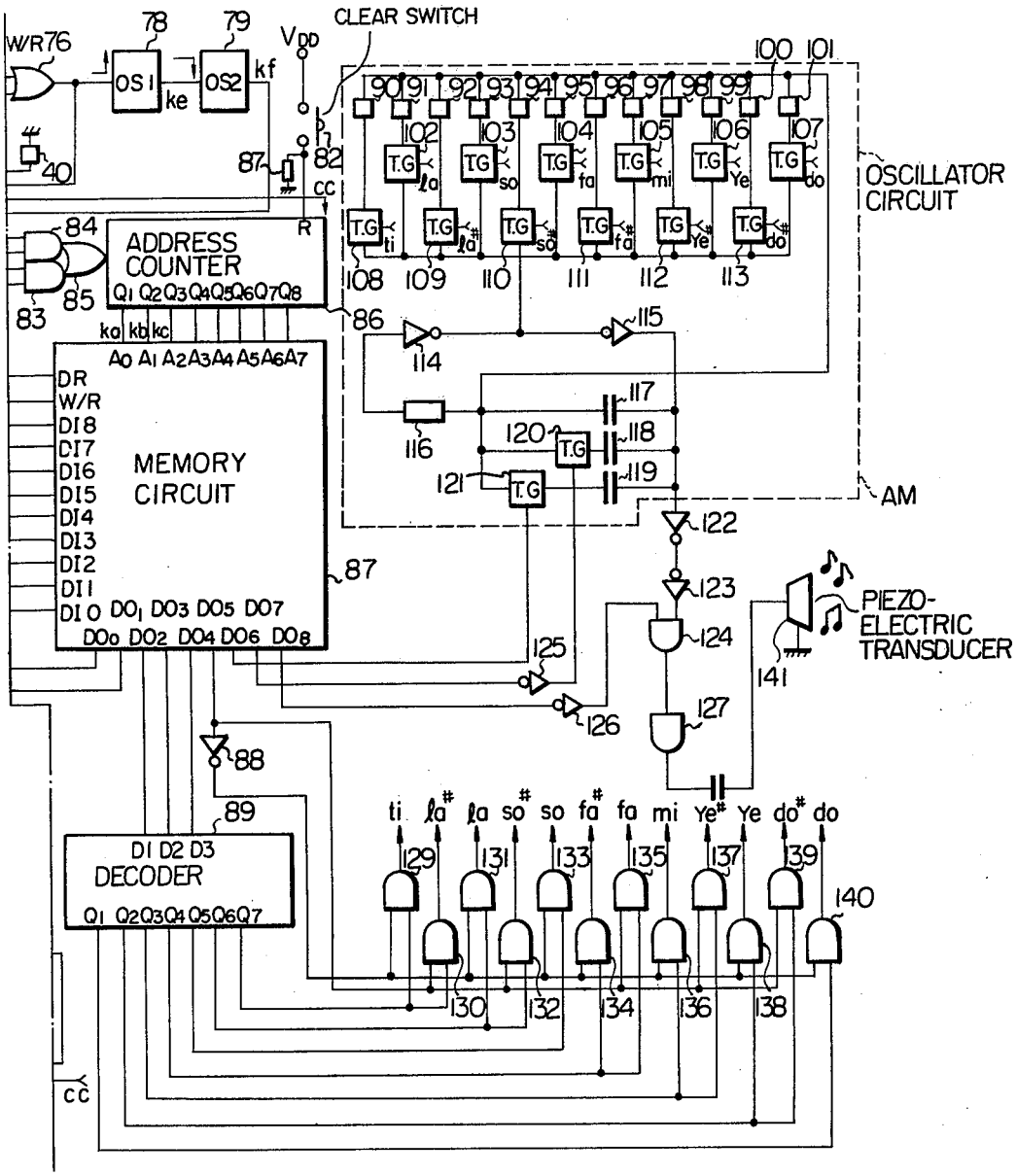
Figure 2:
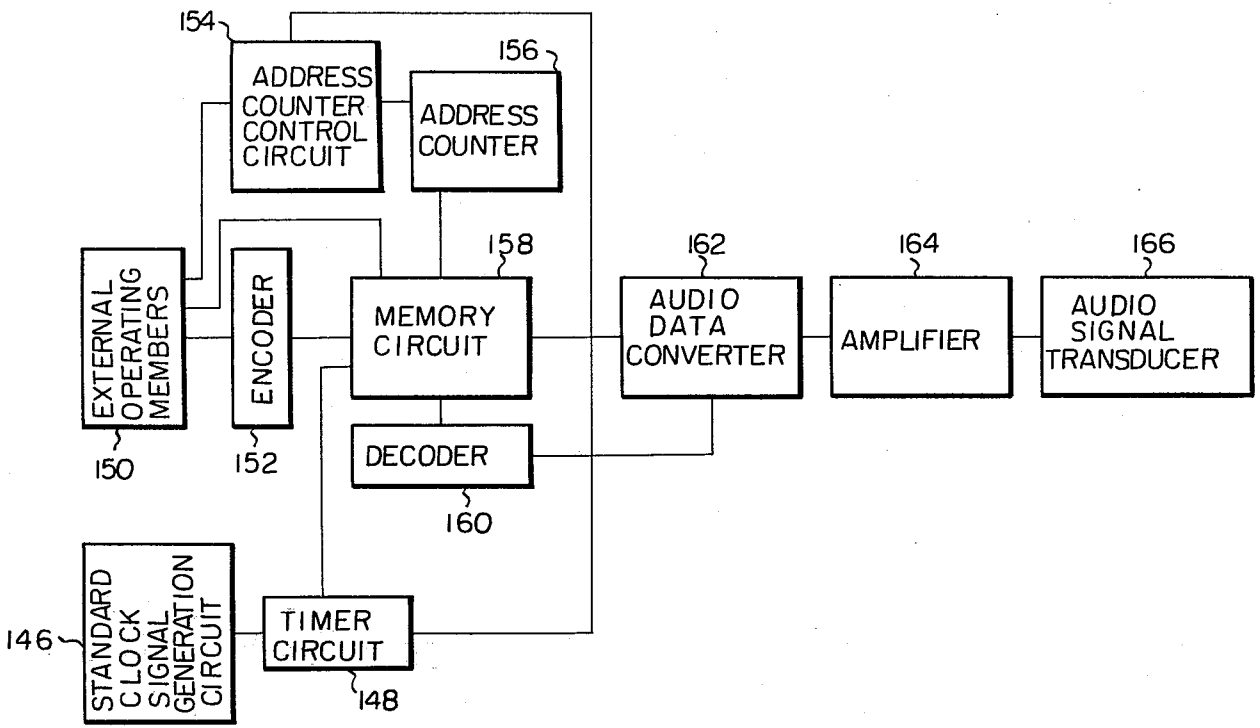
FIG. 2 is a block diagram of the circuit of FIG. 1.
Figure 5:
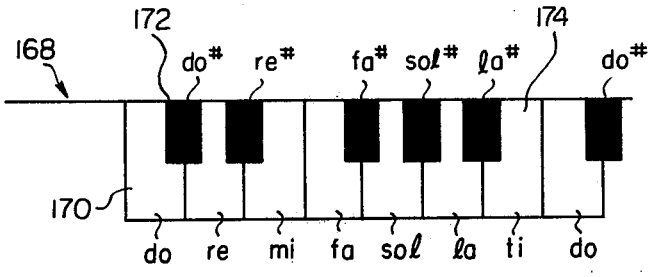
Figure 6:
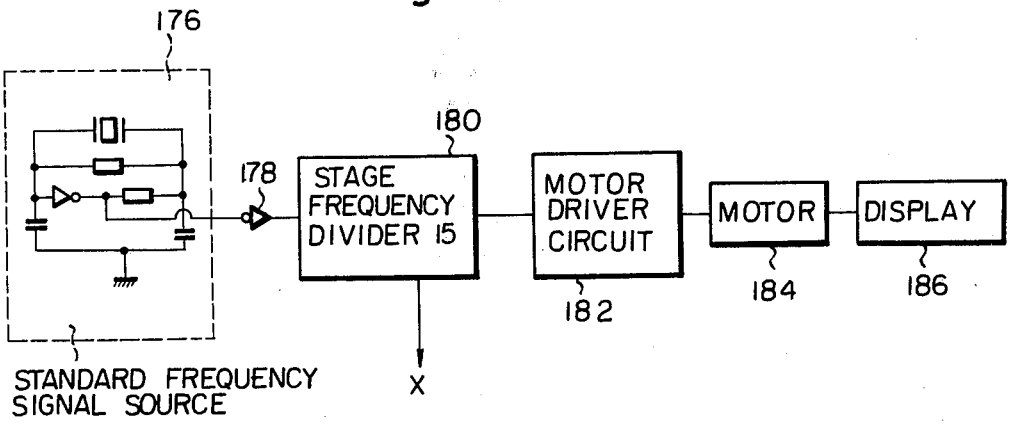

FIG. 4(A) and 4(B) show the form in which data concerning a sequence of musical notes are stored in the memory circuit of the embodiment of FIG. 1;

FIG. 5 shows the relationship between the musical notes referred to in the description of the embodiment of FIG. 1 and the keys of a piano; and FIG. 6 shows the circuit of an electronic timepiece from which a standard frequency clock signal is produced to be supplied to the circuit of FIGS. 1, 1(A) and 1(B).

Referring now to the drawings, FIGS. 1, 1(A), 1(B) and FIG. 2 are circuit and block diagrams respectively of an embodiment of an electronic musical recording device in accordance with the present invention. Numeral 150 in FIG. 2 indicates a plurality of external operating members coupled to switches, which are used to input data concerning music to be recorded and to command writing or replay of musical information. Information concerning the pitch and duration of each of a sequence of musical notes is converted to binary coded form by means of an encoder section 152, when writing in of information is being conducted. The encoded information is stored in a memory circuit 158, in successive memory addresses, with one address corresponding to each of the notes. Address assignment is performed by means of an address counter circuit 156, under the control of an address counter control circuit 154. Timing of the various circuit operations is performed by a timer circuit 148, which is supplied with a standard frequency signal from a standard frequency signal source 146. When it is subsequently desired to reproduce the recorded sequence of musical notes audibly, one of the external operating members 150 is actuated, after the contents of the address counter 156 have been reset to select the first address. The various addresses of memory circuit 158 are then successively selected automatically, and the information in each address is read out to a decoder circuit 160. Decoded information from decoder circuit 160 is applied to an audio data converter 162, to be converted into an audio frequency signal. This audio frequency signal, comprising the sequence of musical notes which was written into the memory circuit 158, is amplified in an audio amplifier circuit 164 and is applied to an audio signal transducer 166.

The circuit diagram of FIGS. 1(A) and 1(B) will now be described, to provide a clearer understanding of the operation of this embodiment of the present invention. In FIG. 1(A), numeral 37 denotes a power supply on/-off switch, which is used to supply power to circuit sections other than the memory circuit only when actually necessary, in order to conserve battery capacity. The parts of the circuit used to write in data will be described first. Numerals 1 to 7 indicate pitch data input switches, which are used to input data for the seven tones of the musical scale do, re, mi, fa, sol, la, and ti respectively. Data produced by actuation of each of tone data input 1 to 7 is memorized by corresponding data-type flip-flops 41 to 47, which also suppress any spurious pulses due to switch bounce. Numerals 14 to 20 denote input resistors, which serve to hold the clock terminals of flip-flops 41 to 47 at the low logic level potential (referred to hereinafter as the L level) when the corresponding key is not being actuated. The Q outputs of each of flip-flops 41 to 47 are connected to inputs of a NOR gate 58, which controls a transmission gate circuit 12. When one of pitch data input keys 1 to 7 is depressed, a high logic level potential (designated hereinafter as the H level) applied through transmission gate 12 is applied to the clock terminal of the corresponding flip-flop of flip-flops 41 to 47. The Q output of this flip-flop then goes to the H level, causing the output of NOR gate 58 to go to the L level, and thereby preventing more than one of flip-flops 41 to 47 from being switched if two or more of the tone data input keys 1 to 7 are depressed almost simultaneously. Numeral 60 denotes an encoder, which converts the signal produced by each of flip-flops 41 to 47 due to actuation of the corresponding pitch data switch into binary coded form, causing one or more of outputs Q1, Q2 and Q3 to go to the H level. The encoded data is applied to data input terminals DI2 to DI4 of a memory circuit 87.

The circuit portion by which the duration of a particular note is input to memory circuit 87 in the form of digital data will now be described. Numerals 8 to 11 denote a group of data input switches which are used to designate the duration of a musical note whose pitch is designated by depressing one of tone data input switches 1 to 7. Each of data input switches 8 to 11 is coupled to the clock terminal of one of a group of data-type flip-flops 48 to 51. The outputs of these flip-flops are connected to inputs of a NOR gate 59, which is connected to a transmission gate 13 to prevent erroneous operation if two or more of data input switches 8 to 11 are depressed simultaneously. The Q outputs of flip-flops 48 to 51 are also coupled to inputs of an encoder 61, which produces a binary coded output on terminals Q1 and Q2. This output is applied to data input terminals DI0 and DI1 of memory circuit 87. Data input switches 8, 9, 10 and 11 are used to designate a musical note as having a duration of a full bar (in common time, sometimes referred to as 4/4 time), ½ of a bar, ¼ of a bar, and ⅛ of a bar, respectively.

Function switches 33, 34, 35 and 36 serve to write in additional data. HALT switch 33 is used to designate a music rest, i.e., a portion of a bar of music in which no note is to be sounded. The duration of a rest is designated in the same way as the duration of a musical note, by means of data input switches 8 to 11 as described above. An OCH switch is used to designate that a musical note is to be raised in pitch by one octave. An OCL switch is used to designate that a musical note is to be lowered in pitch by one octave A sharp switch, or # switch, 36 is used to designate that the pitch of a note is to be raised by one semitone. Data input switches 33 to 36 is used to designate that the pitch of a note is to be raised by one semitone. Date input of a note is to be raised by one semitone. Data input switches 33 to 36 are coupled to input resistors 25, 26, 27 and 28 respectively, and to the clock terminals of data-type flip-flops 54, 55, 56 and 57 respectively, which memorize actuation of the corresponding data input switch. It should be noted that switches denoted by numerals 1 to 11, 31 to 38, and 82 are key type switches which remain closed only while being actuated, and which open when released from actuation. The Q outputs of flip-flops 54 to 57 are connected to data input terminals DI8, DI7, DI6 and DI5 respectively of memory circuit 87.

Numeral 32 denotes a data write (DW) switch, which is used to load the data applied to the data input terminals DI0 to DI8 into memory circuit 87. The DW switch is coupled to the clock terminal of a data-type flip-flop 53, the Q output of which is coupled to the DR control terminal of memory circuit 87. When the DR terminal is raised to the H logic level by the output of flip-flop 53, the Q output of which is coupled to the DR control terminal of memory circuit 87. When the DR terminal is raised to the H logic level by the output of flip-flop 53 the data appearing on data input terminals DI0 to DI8 is stored in memory circuit 87.

The address counter 86 is advanced on the negative-going edge of signal Kd produced from flip-flop 53 due to actuation of the DW switch 32.

A STEP switch is used to successively read out the contents of successive addresses of memory circuit 87, one at a time, for correction purposes. The STEP switch is coupled to the clock terminal of a data-type flip-flop 52, the Q output of which is connected to an input of an OR gate 76. The output of OR gate 76 is connected to an input of an AND gate 84, and to a trigger terminal of a one-shot multivibrator (abbreviated hereinafter to "one-shot") 78. The output of one-shot 78 is coupled to the trigger terminal of another one-shot 79. One-shots 78 and 79 are triggered on the rising edge and on the falling edge of a pulse applied to their trigger terminals, respectively. The output of one-shot 79, denoted Kf, is applied to an input of an OR gate 75, the output of which is coupled to the reset terminals of all of flip-flops 41 to 57.

Numeral 39 denotes a write/read (W/R) control switch, which is connected to an input of AND gate 84 and to an inverter 74 and the write/read (W/R) control terminal of memory circuit 87. When the W/R control switch 39 is not actuated, so that the input to the W/R terminal of memory circuit 87 is at the L level, then reading of data from memory circuit 87 is enabled. When the W/R control switch is actuated, so that an H level input is applied to the W/R terminal of memory circuit 87, then the writing of data into memory circuit 87 is enabled.

A CLEAR switch 82 is coupled to the reset terminal of an address counter 86. When CLEAR switch 82 is actuated, the contents of address counter 86 are reset, this selecting address 0 of memory circuit 87. The contents of address counter, which appear on output terminals Q1 to Q8, are applied to address selector terminals A0 to A7 of memory circuit 87, respectively, and result in a location in memory circuit 87 having an address designated by the contents of address designated by the contents of address counter 86 being selected for reading out or writing in of data. The contents of address counter 86 are successively incremented by input pulses applied from the output of OR gate 85. In the write mode, these pulses are produced by actuation of the STEP switch or of the DW switch, and are applied through OR gate 76 and AND gate 84 to OR gate 85. In the read mode of operation, as described hereinafter, address counter incrementing pulses are input through AND gate 83 to OR gate 85.

Numeral 66 denotes a decoder which has input terminals F1 and F2 coupled to output terminals DO0 and DO1 of memory circuit 87. When reading out of data is conducted, data concerning the duration of each musical note, previously written in at terminals DI0 and DI1 appears on output terminals DO0 and DO1. The data input on terminals F1 and F2 of decoder 66 is decoded to cause one of four output lines G1 to G4 to go to the H level. A timing counter 68 has a reset terminal connected to the output of an OR gate 64, one input of which, designated cc, is applied from CLEAR switch 82, so that timing counter 68 is cleared when CLEAR switch 82 is actuated, i.e. at the same time as address counter 86 is cleared. A standard frequency signal X is applied to a clock terminal of timing counter 68, so that output terminals Q1, Q2, Q3 and Q4 of timing counter 68 successively go to the H level following actuation of the CLEAR switch 82, after predetermined intervals of time. The outputs of timing counter 68 and of decoder 66 are compared by a comparator circuit 67. When an output Q1, Q2, Q3 or Q4 of timing counter 68 and a corresponding one of decoder 66 outputs G1, G2, G3 or G4 are both at the H level, then an output signal is produced by comparator circuit 67 and is applied to the clock terminal of flip-flop 69, causing the Q output of flip-flop 69 to go to the H level. This is applied through OR gate 64 to the reset terminal of timing counter 68, resetting the counter to zero. The output of flip-flop 69 is also applied to a differentiator circuit composed of AND gate 73 and series-connected inverters 70, 71 and 72, which produces a pulse of short duration at the output of AND gate 73, on the L level to H level transition of the output of flip-flop 69. This differentiated pulse, denoted as Lc, is applied through AND gate 83 and OR gate 85 to the clock input of address counter 86.

This pulse is also applied to the trigger input of a one-shot 62, the output of which is applied to the trigger terminal of another one-shot 63. The output of one-shot 63, denoted as Ld, is coupled to the reset terminal of flip-flop 69, so that flip-flop 69 is reset upon the completion of each operation of reading the contents of an address in memory circuit 87.

Numeral 89 denotes a decoder which has input terminals D1, D2 and D3 coupled to output terminals DO2, DO3, and DO4 of memory circuit 87. The encoded data concerning the pitch of each musical note, previously written in on input terminals DI2, DI3 and DI4 of memory circuit 87 appear on output terminals DO2, DO3 and DO4 when data read out is performed, and are decoded by decoder 89 to cause one of output terminals Q1, Q2, Q3, Q4, Q5, Q6 or Q7 to go to the H level. These output terminals are coupled to inputs of and gates 140, 138 and 139, 136 and 137, 134 and 135, 133, 131 and 132, and 129 and 130, respectively, the outputs of which are used to specify generation of the musical notes do, do#, re, re#, mi, fa, fa#, sol, sol#, la, la# and ti, respectively. AND gates 129, 131, 134, 136, 138 and 140 are controlled by the output of an inverter 88, which inverts an output appearing on terminal DO5 of memory circuit 87 when reading out of data is performed. AND gates 130, 132, 135, 137, and 139 are controlled by the direct output from terminal DO4. If a particular note has been specified as being raised by one semitone at the time of writing in data, by actuation of switch 36, then the output of terminal DO5 will be at the H level when data concerning that note is read out of memory circuit 87. Thus, the appropriate sharp note will be selected by the output of decoder 89 which is at the H level at this time and the output of terminal DO5, acting upon one of AND gates 130, 132, 135, 137 and 139. If function switch 36 was not actuated at the time of writing in the data for a particular note, then terminal DO5 will remain at the L level when data for that note is read out of memory circuit 87. The output of inverter 88 will therefore be at the H level at this time, so that the appropriate note is selected by the output from decoder 89 which is at the H level, in conjunction with the output of inverter 88, acting upon one of AND gates 129, 131, 134, 136, 138 and 140.

Generation of an electrical signal of frequency specified by the output of one of AND gates 129 to 140 is performed by an audio conversion circuit, comprising an oscillator circuit based on a pair of inverters 114 and 115. Inverters 114 and 115 are connected in series with a resistance-capacitance network to form a positive feedback loop, and oscillation occurs at a frequency determined by the time constant of the resistance capacitance network. This network is selected from components comprising a resistor 116, a group of resistors 90 to 101, and a group of capacitors 117, 118 and 119. Each of resistors 90, 92, 94, 96, 98 and 100 can be selectively connected into the resistance-capacitance network by a control signal applied to a corresponding transmission gate 108, 109, 110, 111, 112 or 113. Each of resistors 91, 93, 95, 97, 99 and 101 can be selectively connected into the resistance-capacitance network by a control signal applied to a corresponding transmission gate 102, 103, 104, 105, 106 or 107. Signals controlling transmission gates 102 to 113 are produced by AND gates 129 to 140, as described above.

Capacitor 118 can be selectively connected into the resistance-capacitance network of the oscillator circuit by a control signal applied from the output of an inverter 125 to a transmission gate 120. The input of inverter 125 is connected to output DO7 of memory circuit 87. Normally, the output from DO7 will be at the L level, so that the H level output of inverter 125 causes transmission gate 120 to connect capacitor 118 in parallel with capacitor 120. However, if function key 34 is depressed when data for a particular musical note is being written into memory circuit 87, then the output from terminal DO7 will be at the H level when data for this note is read out. Thus, the output from inverter 125 will inhibit transmission gate 120 from connecting capacitor 120 into the resistance-capacitance network of the oscillator circuit, causing the frequency of the oscillator signal to be doubled.

Capacitor 119 is connected in series with a transmission gate 121, which is controlled by the output from the DO6 terminal of memory circuit 87. Normally, the output of terminal DO6 is at the L level, so that transmission gate 121 holds capacitor 119 disconnected from the resistance-capacitance network of the oscillator circuit. However, if function key 35 is depressed at the time of writing in data for a particular note to memory circuit 87, then the output from terminal DO6 will be at the H level when data for this note is read out. Transmission gate 121 will therefore connect capacitor 119 into the resistance-capacitance network of the oscillator circuit, causing the oscillator frequency to be halved.

The output signal from the oscillator circuit is applied to an AND gate 124 through inverters 122 and 123. The other input of AND gate 124 is connected to the output of an inverter 126, whose input is coupled to output terminal DO8 of memory circuit 87. Normally, the output of terminal DO8 is at the L level. However, if the function key 33 is depressed at some point in the sequence or writing in musical notes, then the output from terminal DO8 will go to the H level at that point in the sequence of reading out the data from memory circuit 87. The output of inverter 126 will therefore go to the L level, thereby inhibiting the transfer of the signal from the oscillator circuit, appearing on the output of inverter 123, through AND gate 124. The output of AND gate 124 is applied to an inverter stage 127, whose output is capacitatively coupled by a capacitor 128 to a piezo-electric device serving as an audio signal transducer 141, which converts the electrical signal from amplifier 127 into an audible signal.

Figure 3:
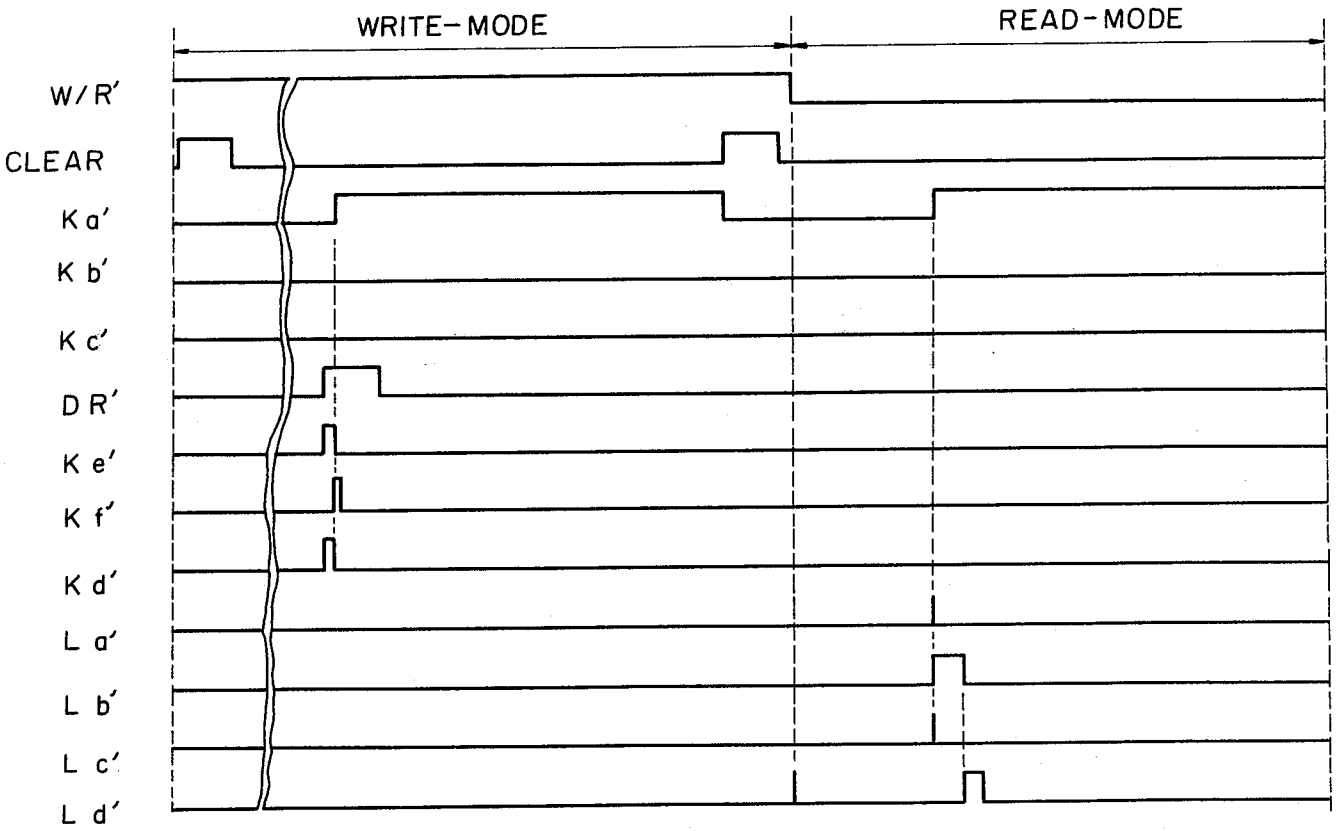
FIG. 3 is a waveform diagram illustrating the operation of the embodiment of FIG. 1 and FIG. 2.

The operation of the circuit during writing in and reading out of music data will now be described, referring to the circuit diagram of FIGS. 1(A) and 1(B) and the waveform diagram of FIG. 3. First, to begin writing in a set of data corresponding to a sequence of musical notes, the W/R switch is set to the WRITE (i.e. closed) position, and the CLEAR key 82 is depressed. This resets the contents of address counter 86 to select address O of the memory circuit. One of data input switches 1 to 7 is then actuated, to select the desired pitch of the first musical note to be written in. This causes the Q output of one of flip-flops 41 to 47 to go to the H level, and remain there after the switch is released. Encoded outputs corresponding to the actuated data input switch are output from encoded 60, and input to memory circuit 87. If the pitch is to be raised by a semitone, to make the note a sharp, then function switch 36 is now actuated, causing the output of flip-flop 57 to go to the H level. If the pitch of the note is to be raised by an octave, then function switch 34 is actuated, causing the output of flip-flop 55 to go to the H level. If, on the other hand, the pitch of the note is to be lowered by one octave, then function switch 35 is actuated, causing the output of flip-flop 56 to go to the H level. If, instead of a musical note, a rest is to be written in, then function switch 33 is actuated, causing the output of flip-flop 54 to go to the H level. To determine the duration of the selected note or rest, one of data input switches 8, 9, 10 or 11 is now actuated, causing the output of the corresponding one of flip-flops 48, 49, 50 and 51 to go to the H level. The data specifying the first note are now being applied to the input terminals DI0 to DI8 of the memory circuit 87. To write this data into address 0 of memory circuit 87, the data write switch 32 is now actuated, causing the output of flip-flop 53 to go to the H level, delivering an input designated DR' in FIG. 3 to the DR control terminal of memory circuit 87, causing writing in of data to be performed. The output of flip-flop 53, applied through OR gate 76, causes one-shot 78 to be triggered on the rising edge of signal Dr', to produce signal Ke'. The negative-going edge of signal Ke' triggers one-shot 79 to produce signal Kf'. Signal Kf', applied through OR gate 75, resets all of flip-flops 41 to 57. The negative-going edge of the DR' signal, applied through OR gate 76, AND gate 84 and OR gate 85, causes a count of one to be input to address counter 86, so that the Q2 output terminal of address counter 86 goes to the H level, shown as signal Ka' in the waveform diagrams of FIG. 3. This completes the process of writing in the data specifying the first note of the musical sequence into memory circuit 87.

To write in the data for the second note (or rest), the appropriate data input and function switches are depressed, as described above, and then the data write key 32 is actuated again. Data concerning the second note of the musical sequence are thereby written into address 1 of memory circuit 87, and address counter 86 is advanced. Similarly, the remaining data for the notes of the musical sequence are written into successive addresses of memory circuit 87.

In order to successively produce the various address selection signals Ka, Kb, etc. from address counter 86 without performing writing in of data, the STEP key is actuated after the CLEAR key has been depressed to reset the contents of address counter 86 to select address 0. The contents of a particular address can thus be corrected, if required, by repeatedly actuating the STEP key until the desired address is reached, and then new data can be written into that address, by actuating the appropriate data input switches of groups 1 to 7, 8 to 11, and 33 to 36 and then actuating the data write key 32.

The operation of the circuit when reading out data from memory circuit 87, in order to reproduce a musical sequence for which data has been stored, will now be described. When writing in of data is completed, the CLEAR switch is actuated to reset address counter 86 to select address 0 of memory circuit 87 and then the write/read control key 39 is set to the READ position, (i.e. the open position), so that an L level signal is applied from this switch to AND gate 84, inhibiting this gate. Thus, signals produced by actuation of the data write switch 32 or the STEP switch 31 will not be applied to the address counter 86 in this mode. An H level signal is now applied from the output of inverter 74 to an input of AND gate 83. The L level output from switch 39 is also applied to the W/R control input terminal of memory circuit 87, to place memory circuit 87 in the read mode. When the CLEAR switch 82 is depressed, then the contents of address counter 86 are reset to the initial state in which address 0 of memory circuit 87 is selected, while at the same time the CLEAR switch H level output is applied (designated as cc in FIG. 1(B)) through OR gate 64 to the reset terminal of timing counter 68, resetting this counter to a count of zero. At this time, since memory circuit 87 is in the read mode and since address 0 is selected, the encoded data specifying the pitch of the first note in the stored musical sequence appears at output terminals DO2, DO3 and DO4 of memory circuit 87. The encoded duration data for this note, which was previously written in at terminals DI0 and DI1 is decoded by decoder 66, causing one of outputs G1, G2, G3 and G4 to go to the H level. After a time determined by comparator circuit 67 detecting coincidence between one of outputs Q1 to Q4 of timing counter 68 and the H level terminal of G1 to G4, as described previously, the output of flip-flop 69 goes to the H level, and a short duration pulse Lc is produced by AND gate 73. This pulse is applied through AND gate 83 to address counter 86, thereby advancing the counter to the next address, and thereby terminating the output of pitch specifying data for the first note from terminals DO2 to DO4 of memory circuit 87, and causing the data for the next note of the musical sequence to appear on these terminals.

Thus, the various data which specify the first note (or rest) of the musical sequence appear on terminals DO2 to DO8 of memory circuit 87 for a time which is determined by the data output from terminals DO0 and DO1. If a rest has been specified for the first part of the musical sequence, then an H level output appears on terminal DO8, causing AND gate 124 to be inhibited, so that no sound is produced by transducer 141 during the specified time. If the first note has been specified as being raised in pitch by a semitone, then the output of DO5 is at the H level during the specified time, thereby causing a signal specifying the appropriate sharp note to be output from one of gates 129 to 140. If the first note has been specified as being raised in pitch by one octave, then the output of DO7 is at the H level during the specified time, causing transmission gate 120 to disconnect capacitor 118 from the resistance-capacitance network of the oscillator circuit. If the first note has been specified as being lowered in pitch by one octave, then the output of DO6 is at the H level for the specified time, causing transmission gate 121 to connect capacitor 119 into the resistance-capacitance network of the oscillator circuit.

Similarly, when the output of AND gate 73 has caused address counter 86 to advance to the next address, the various data concerning the next note in the musical sequence are produced on output terminals DO0 to DO8 of memory circuit 87, and the second note is thereby produced for a time duration which is determined by the data output from terminals DO0 and DO1. In this way, the various addresses in memory circuit 87 are successively selected and their data contents read out, to provide an automatic performance of the musical sequence which has been stored in memory circuit 87.

To further clarify the above description, FIG. 4(A) shows a typical musical sequence which can be recorded by the embodiment of FIGS. 1(A) and 1(B), while FIG. 4(B) shows the data which is stored in each address of memory circuit 87 for the sequence of FIG. 4(A). The sequence shown in FIG. 4(A) consists of four bars of music. The first note of the first bar is la, and has a duration of $\frac{1}{2}$ of a bar. The data specifying a duration of $\frac{1}{2}$ bar comprises the bits $b_0$ and $b_1$ of address 0 in memory circuit 87, i.e. the binary data 01. The data specifying the pitch corresponding to la comprises bits $b_2$, $b_3$ and $b_4$ of address 0, namely, 011 in binary. The note is not to be raised or lowered in pitch, so that all of the other bits of address 0 have a value of zero. The second note of the musical sequence is so, and has a duration of $\frac{1}{8}$ of a bar. The latter duration is specified by the contents of bits $b_0$ and $b_1$ of address 1, i.e. as 00. The pitch is specified by address bits $b_2$, $b_3$ and $b_4$ as 101. Similarly, the third, fourth, sixth, seventh, eighth and ninth notes are specified by the contents of addresses 2, 3, 4, 5, 6, 7 and 8. The tenth note of the sequence is a sharp, i.e. it is raised in pitch by a semitone. Bit $b_5$ of the address 9 is therefore set to 1. In addition, the tenth note of the sequence has a duration of one full bar, so that bits $b_0$ and $b_1$ are set to values of 11.

The final part of the musical sequence is a half-bar rest. This time duration is specified by bits $b_0$ and $b_1$ being 01, and the rest is specified by bit $b_8$ being 1, in address 13 of memory circuit 87.

The notation used for musical notes in the present specification, i.e., do, re, mi, fa, sol, la and ti, designates tones in the key of C major, as indicated in FIG. 4(A). Corresponding keys on a piano keyboard, which would produce these tones when depressed, are shown in FIG. 5. These notes are arranged according to the equal-tempered scale, in which adjacent musical notes of the scale are separated by a semitone. The pitch ratios of the notes in the equal-tempered scale are shown in the table below.

| | | | | | | | | |
|---|---|---|---|---|---|---|---|---|
| Note | do | re | mi | fa | sol | la | ti | do |
| Pitch ratio | 1 | $\frac{9}{8}$ | $\frac{5}{4}$ | $\frac{4}{3}$ | $\frac{3}{2}$ | $\frac{5}{3}$ | $\frac{15}{8}$ | 2 |
| Note | do# | re# | | fa# | sol# | la# | | do# |
| Pitch ratio | $\frac{17}{16}$ | $\frac{19}{16}$ | | $\frac{17}{12}$ | $\frac{19}{12}$ | $\frac{85}{48}$ | | $1\frac{17}{16}$ |

The pitch of each note in the scale, in the case of the key of C major, is obtained by multiplying the pitch of do by the appropriate pitch ratio, as given above.

The various notes of the equal-tempered scale can thus be produced by arranging the values of capacitors 117, 118 and 119 of the embodiment of FIG. 1(B), together with the values of resistors 90 to 107, such that oscillator signals having frequency ratios corresponding to the above pitch ratios are produced in response to output signals from AND gates 129 to 140.

It should be noted that, although the present embodiment has been described as producing musical notes arranged in accordance with the equal-tempered scale, this is not an essential feature of the present invention, and various other arrangements of the pitch ratios of musical notes may be utilized.

Figure 4:
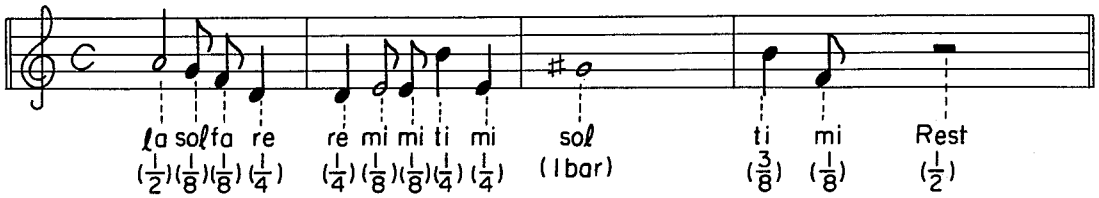

FIG. 6 shows a block diagram of an electronic timepiece which may be used in conjunction with the embodiment of the present invention shown in FIG. 4, whereby the timekeeping circuit of the electronic timepiece produces a clock signal which is used for timing and control purposes in the electronic musical instrument. Numeral 176 denotes a crystal controlled oscillator circuit serving as a standard frequency signal source, which produces a standard frequency signal that is applied through an inverter used as a buffer stage, 178, to a 15-stage frequency divider circuit 180. Frequency divider circuit 180 produces a standard time signal having a period of one second, which is applied to a motor drive circuit 182, to drive the motor 184 which is coupled to time indicating hands of a time display 186. Frequency divider circuit 180 also produces a signal designated X, which is used as a timing signal in the embodiment of the present invention shown in FIGS. 1(A) and 1(B). Since a timing signal X of suitable frequency is readily available from the timekeeping circuit of an electronic timepiece, and since an electronic musical instrument according to the present invention can be formed entirely upon an integrated circuit chip, with the exception of switches and the audio transducer, it will be apparent that an electronic musical instrument according to the present invention can readily be incorporated into an electronic timepiece of small size such as an electronic wristwatch. If incorporated into an electronic timepiece, the functions performed by actuating the CLEAR switch and opening the read/write switch 39 in the embodiment described herein can be performed by circuit means which generates a signal to indicate coincidence between a preset alarm time and the current time, to thereby cause a stored sequence of musical notes to be audibly reproduced. The sequence of musical notes produced by the electronic musical instrument can thus be used to provide a more pleasing type of alarm indication than has been hitherto available in an electronic timepiece equipped with an alarm function. The applications of an electronic musical instrument according to the present invention are not limited to electronic timepieces, however, as such an instrument could for example also be incorporated into an electronic calculator.

It should also be noted that, although the embodiment of the present invention described hereinabove utilized a memory into which data can be freely written, so that previously written data can be removed or modified, it is equally possible to utilize a read-only type of memory commonly referred to as a ROM. In this case, a predetermined sequence of musical notes can be stored in the memory circuit at the time of manufacture, in the form of fixed binary data. Such a musical instrument would be limited to producing a single musical sequence, unless a plurality of read-only memory circuits were utilized.

From the above description, therefore, it will be apparent that an electrophonic musical instrument in accordance with the present invention can be made of extremely small size, and that data specifying a sequence of musical notes, which can extend over a range of three octaves or more, can be stored in a memory circuit and subsequently read out to enable reproduction of the sequence of musical notes by means of an audio transducer to be accomplished.

Although the present invention has been shown and described with reference to a specific embodiment, it should be noted that various changes and modifications to the embodiment are possible, which come within the scope claimed for the present invention.

What is claimed is:

1. An electronic timepiece in combination with an electrophonic musical instrument, comprising:

a source of a standard high frequency signal;

frequency divider means responsive to said standard high frequency signal for generating a standard frequency signal and a standard time signal;

time display means;

drive means responsive to said standard time signal for driving said time display means to provide a display of time;

memory circuit means having a plurality of addresses for storage of data;

address counter means coupled to said memory circuit means for providing an output signal to select an address of said memory circuit means;

a first control switch coupled to circuit means for selectively enabling writing of data into and reading of data out of an address of said memory circuit means selected by said output signal from said address counter means;

a plurality of data input switches coupled to circuit means for selectively generating data specifying at least the pitch and the duration of a musical note;

a second control switch coupled to circuit means for causing said data generated by said data input switches to be written into an address of said memory circuit means selected by said output signal from said address counter means when writing of data into said memory circuit means is enabled by said first control switch;

a third control switch coupled to circuit means for resetting said address counter to a count of zero;

timing counter circuit means having a count input terminal coupled to receive said standard frequency signal, said timing counter circuit means being responsive to a signal produced by said third control switch for being reset to a count of zero simultaneously with said address counter being reset to zero, and being responsive to said standard frequency signal for counting after having been reset to a count of zero;

comparator circuit means coupled to output terminals of said timing counter circuit and coupled to receive data read out from said memory circuit means indicating the duration of a musical note, said comparator circuit means producing an output signal which is applied to said address counter to thereby advance the contents thereof by a count of one when coincidence is detected by said comparator circuit means between a count of said timing counter circuit and said data read out from said memory circuit means;

circuit means for resetting said timing counter circuit to a count of zero when said coincidence is detected;

audio signal conversion circuit means coupled to receive data read out of said memory circuit means specifying the pitch of a musical note, and for converting said data into an alternating electrical signal having a frequency corresponding to said specified pitch; and piezo-electric transducer means responsive to said alternating electrical signal for producing an audible signal.

2. An electronic timepiece in combination with an electrophonic musical instrument according to claim 1, and further comprising encoder circuit means coupled to said plurality of data input switches for converting signals produced by actuation of said data input switches into binary code combinations for storage in said memory circuit means, and further comprising decoder circuit means coupled between said audio signal conversion circuit means and output terminals of said memory circuit means, for converting said binary code combinations into signals corresponding to said signals produced by actuation of said data input switches.

3. An electronic timepiece in combination with an electrophonic musical instrument according to claim 2, wherein said audio signal conversion means comprises an oscillator circuit having frequency determining circuit means for determining the oscillation frequency thereof controlled by output signals from said decoder circuit means.

4. An electronic timepiece in combination with an electrophonic musical instrument according to claim 3, wherein said frequency determining circuit means comprises a network containing resistive and capacitative circuit elements, and further comprising transmission gate means coupled to said network and responsive to signals produced by said decoder circuit means for selectively connecting said resistive and capacitative elements into said network to thereby control said oscillation frequency of said oscillator circuit.

* * * * *